US009498986B2

(12) United States Patent
Choi

(10) Patent No.: US 9,498,986 B2
(45) Date of Patent: Nov. 22, 2016

(54) DEVICE FOR SUPPLYING AND RECOVERING PRINTED MATERIAL USED IN DIGITAL PRINTING

(71) Applicant: DILLI, Gyeonggi-do (KR)

(72) Inventor: Geun-Soo Choi, Seoul (KR)

(73) Assignee: DILLI, Gyeonggi-Do (KR)

( * ) Notice: Subject to any disclaimer, the term of this patent is extended or adjusted under 35 U.S.C. 154(b) by 0 days.

(21) Appl. No.: 14/439,188

(22) PCT Filed: Aug. 26, 2013

(86) PCT No.: PCT/KR2013/007569
§ 371 (c)(1),
(2) Date: Apr. 28, 2015

(87) PCT Pub. No.: WO2014/077494
PCT Pub. Date: May 22, 2014

(65) Prior Publication Data

US 2015/0273904 A1 Oct. 1, 2015

(30) Foreign Application Priority Data

Nov. 19, 2012 (KR) ..... 10-2012-0131055

(51) Int. Cl.
*B41J 15/16* (2006.01)
*B65H 23/18* (2006.01)
*B41J 15/04* (2006.01)
*B65H 23/188* (2006.01)

(52) U.S. Cl.
CPC ..... *B41J 15/042* (2013.01); *B41J 15/16* (2013.01); *B41J 15/165* (2013.01); *B65H 23/188* (2013.01)

(58) Field of Classification Search
CPC ..... B41J 15/046; B41J 15/16; B41J 15/165; B65H 23/1888; B65H 23/188
See application file for complete search history.

(56) References Cited

U.S. PATENT DOCUMENTS 5,825,374 A * 10/1998 Albertalli ..... B41J 11/0085 226/156
6,349,867 B1 * 2/2002 Fernfors ..... B65H 20/08 156/265
8,377,249 B2 * 2/2013 Gill ..... B65H 20/02 156/324
9,144,624 B2 * 9/2015 Schneider ..... B29C 65/08
2007/0059083 A1 * 3/2007 Silverbrook ..... B41J 15/165 400/614
2008/0253823 A1 * 10/2008 Kanbara ..... B41J 11/001 400/642
2011/0285801 A1 * 11/2011 Okura ..... B41J 15/02 347/104

* cited by examiner

*Primary Examiner* — Daniel J Colilla
(74) *Attorney, Agent, or Firm* — TIPS Group

(57) ABSTRACT

The present invention relates to a device for supplying and recovering printed material used in digital printing with which a long printed material can be simply mounted onto a digital printing apparatus so that the work efficiency of an operator can be improved. The present invention includes: a supply roll around which the printed material is wound; a first transport roll which transports the printed material supplied from the supply roll to the lower part of a head part; a second transport roll which discharges the printed material on which printing is completed by the head part; and a recovery roll which has an axis of rotation parallel to the axis of rotation of the supply roll and which is rotated by a recovery driving means so that the printed material discharged from the second transport roll is wound. The printed material is supplied when one end thereof is unwound from the supply roll and is fixed to the recovery roll through the upper sides of the first transport roll and the second transport roll.

2 Claims, 6 Drawing Sheets

DEVICE FOR SUPPLYING AND RECOVERING PRINTED MATERIAL USED IN DIGITAL PRINTING

TECHNICAL FIELD

The present invention relates to a device for supplying and rewinding an object to be printed for digital printing, and more specifically, to a device for supplying and rewinding an object to be printed for digital printing which is capable of simply mounting a long object to be printed in a digital printer with improved working efficiency of an operator.

BACKGROUND ART

When using a long object to be printed in a digital printer, a roll on which the long object to be printed is wound is used. In this case, the object to be printed should be transferred to a lower side of a head of the digital printer at a constant velocity, while applying a constant tension thereto.

To transfer an object to be printed for digital printing in the related art, as illustrated in FIG. 1, there is a digital printer 100 including a first transfer roll 110 and a second transfer roll 112 which are disposed on a front and rear about a head unit 102 thereof, respectively, a first auxiliary roll 108 disposed upstream from the first transfer roll 110, and a second auxiliary roll 114 disposed downstream from the second transfer roll 112. Herein, the first auxiliary roll 108 and the second auxiliary roll 114 are positioned below the first transfer roll 110 and second transfer roll 112, respectively. As a result, since a contact area of an object 10 to be printed with the first transfer roll 110 and second transfer roll 112 is increased, it is possible to stably transfer the object 10 to be printed with an increased frictional force.

In addition, a supply roll 104 is disposed upstream from the first transfer roll 110 for supplying the object 10 to be printed to the first transfer roll 110, and a rewinding roll 118 is disposed downstream from the second transfer roll 112 for rewinding and collecting the object 10 with an image printed thereon.

Herein, a process for mounting the object 10 to be printed in the digital printer 100 having the above-described configuration will be described with reference to FIG. 2. First, one end of the object 10 to be printed being supplied from the supply roll 104 is unwound, and sequentially passed through the first auxiliary roll 108, the first transfer roll 110, the second transfer roll 112, and the second auxiliary roll 114. Then, the one end of the object 10 to be printed is fixed to the rewinding roll 118.

However, in the related art, even though the digital printer 100 has a large size, it is very cumbersome for the operator to manually pass the object 10 to be printed through the first transfer roll 110 via the first auxiliary roll 108, the second transfer roll 112, and the rewinding roll 118 via the second auxiliary roll 114. Further, since the object 10 to be printed is made of a thin material such as paper or a film, or the like, when a force is not uniformly applied thereto in a width direction thereof, the object to be printed may be torn or strained. In addition, if the object 10 to be printed is not accurately mounted on the first transfer roll 110 and second transfer roll 112, the straightness thereof is varied, and thereby printing on the object to be printed may be deteriorated and wrinkles may be formed thereon. Therefore, there may be a problem that the wrinkles generated on the object contact a lower surface of the head unit 102 of the digital printer 100 to cause damage in a head (not illustrated).

DISCLOSURE

Technical Problem

In consideration of the above-mentioned circumstances, it is an object of the present invention to provide a device for supplying and rewinding an object to be printed for digital printing which is capable of simply mounting a long object to be printed in a digital printer with improved working efficiency of an operator.

Another object of the present invention is to provide a device for supplying and rewinding an object to be printed for digital printing in which an object to be printed is accurately mounted at a position during firstly fixing one end of the object to be printed to a rewinding roll, thereby an image may be printed on a desired position of the object to be printed without a deviation in a width direction thereof even in a continuous printing work.

Technical Solution

In order to accomplish the objects, according to an aspect of the present invention, there is a device for supplying and rewinding an object to be printed for digital printing including: a supply roll on which the object to be printed is wound; a first transfer roll which transfers the object to be printed being supplied from the supply roll to a lower side of a head unit; a second transfer roll which discharges the object printed with an image by the head unit; and a winding roll which has a rotation axis parallel to a rotation axis of the supply roll, and is rotated by a rewinding drive means so as to rewind and collect the object printed with an image being discharged from the second transfer roll, wherein one end of the object to be printed is unwound and supplied from the supply roll, passed through an upper side of the first transfer roll and the second transfer roll, and fixed to the rewinding roll.

The supply roll may include a tension maintaining means configured to apply a constant tension to the object to be printed which is mounted between the supply roll and the rewinding roll through the first and second transfer rolls.

The tension maintaining means may be any one of a braking device, a deceleration device, and a reverse rotating device.

A first guide may be disposed between the supply roll and the first transfer roll, and a second guide may be disposed between the second transfer roll and the rewinding roll, a first auxiliary roll may be movably installed in a first guide and configured to, after passing the object to be printed through the first and second transfer rolls and fixing to the rewinding roll, come close and press the object to be printed loosely positioned between the supply roll and the first transfer roll so as to increase a contact area of the object be printed with the first transfer roll, and a second auxiliary roll may be movably installed in a second guide and configured to, after passing the object to be printed through the first and second transfer rolls and fixing to the rewinding roll, come close and press the object to be printed loosely positioned between the second transfer roll and the rewinding roll so as to increase the contact area of the object be printed with the second transfer roll.

The first auxiliary roll may be installed in the first guide so that the object to be printed is proceeded along the outer circumference of the first transfer roll positioned at an interval therewith.

The second auxiliary roll may be installed in the second guide so that the object to be printed is proceeded along the outer circumference of the second transfer roll positioned at an interval therewith.

When any one of the first auxiliary roll and the second auxiliary roll is completely moved, the other auxiliary roll may be moved.

Advantageous Effects

According to the present invention, since the operator may easily mount the long object to be printed in the digital printer, a work time and work intensity may be reduced.

In addition, when firstly fixing the object to be printed to the rewinding roll by supplying from the supply roll, since the object to be printed may be fixed to the rewinding roll without wrinkles while applying a constant tension thereto, if rotation axes of the supply roll and the rewinding roll are parallel to each other, the object to be printed is always mounted on the rotation axes of the rewinding roll perpendicular thereto without an error. Accordingly, there is no deviation in a width direction of the object to be printed even in a continuous printing work, and printing quality may be improved.

BEST MODE

Figure 1:
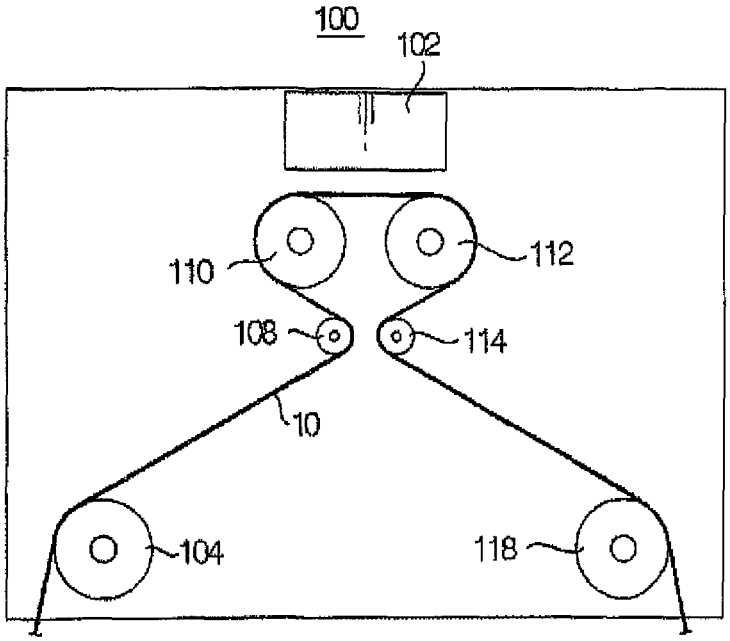
FIG. 1 PRIOR ART
FIG. 1 is a schematic view illustrating a configuration of a digital printer in which a device for supplying and rewinding an object to be printed for digital printing is mounted of a related art.
Figure 2:
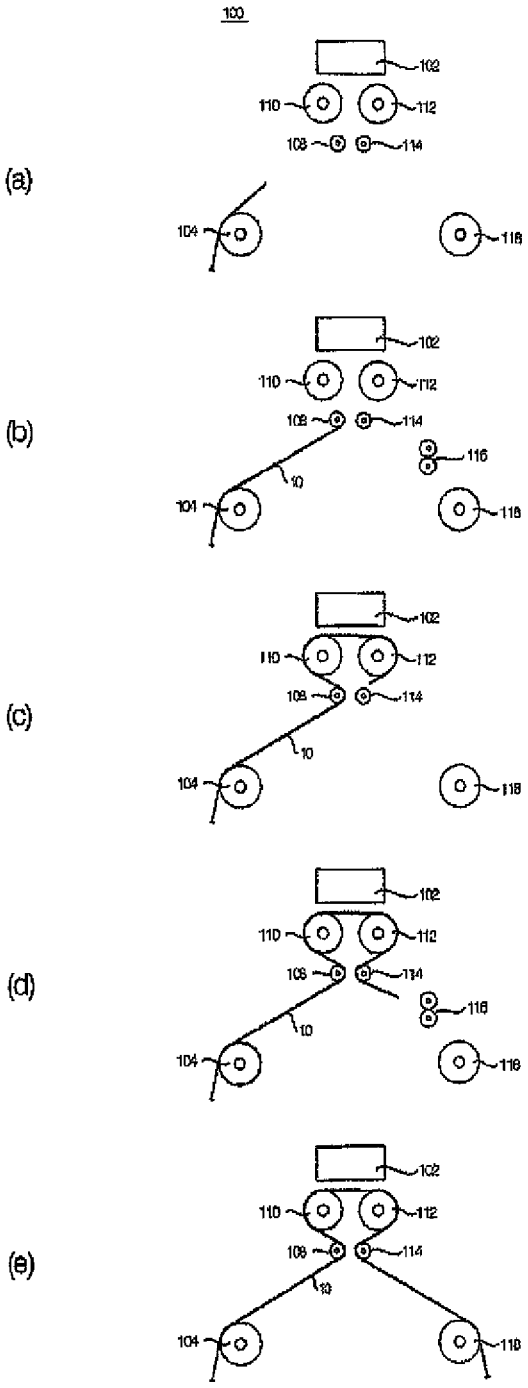
FIG. 2 PRIOR ART
FIG. 2 is views illustrating a process of mounting the object to be printed in the digital printer of FIG. 1.

Hereinafter, preferable embodiments of the present invention will be described with reference to the accompanying drawings. Referring to the drawings, wherein like reference characters designate like or corresponding parts throughout the several views. In the embodiments of the present invention, a detailed description of publicly known functions and configurations that are judged to be able to make the purport of the present invention unnecessarily obscure will be omitted.

Figure 3:
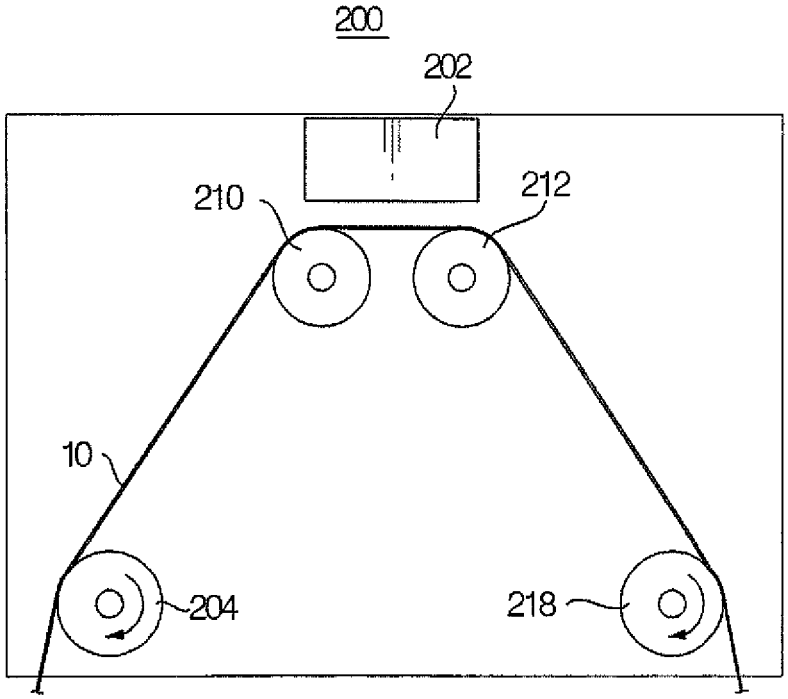
FIG. 3 is a schematic view illustrating a configuration of a digital printer in which a device for supplying and rewinding an object to be printed for digital printing is mounted in according to a first embodiment of the present invention.
Figure 4:
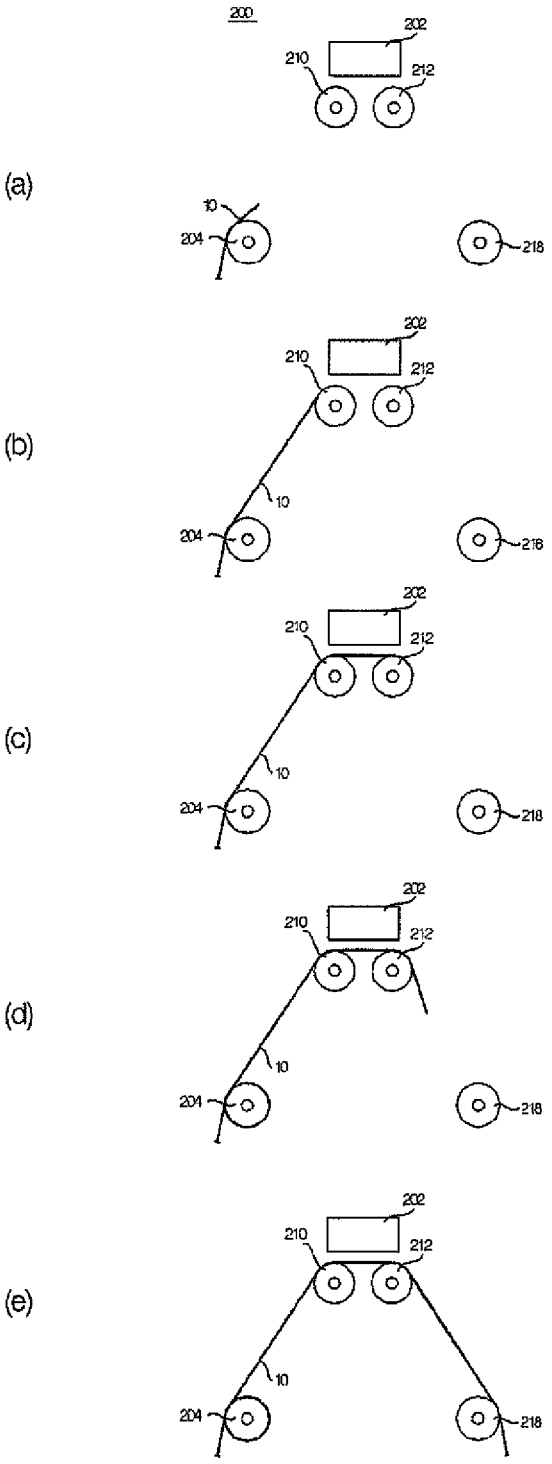
FIG. 4 is views illustrating a process of mounting the object to be printed in the digital printer of FIG. 3.

Hereinafter, a digital printer 200 in which a device for supplying and rewinding an object to be printed for digital printing is mounted according to a first embodiment of the present invention will be described with reference to FIGS. 3 and 4.

The device for supplying and rewinding an object to be printed for digital printing is characterized by allowing an operator to fix an object 10 to be printed being supplied from a supply roll 204 to a rewinding roll 218, and exactly fix the object 10 to be printed to a rotation axis of the rewinding roll 218 perpendicular thereto, so that the object 10 to be printed is accurately rewound onto the rewinding roll 218 without a deviation in a width direction of the object 10 to be printed even in a continuous printing work. The device for supplying and rewinding an object to be printed for digital printing having the above-described characteristic includes the supply roll 204 on which the object 10 to be printed is wound, a first transfer roll 210 which transfers the object 10 to be printed being supplied from the supply roll 204 to a lower side of a head unit 202, a second transfer roll 212 which discharges the object 10 printed with an image by the head unit 202, and the rewinding roll 218 which rewinds and collects the object 10 printed with an image being discharged from the second transfer roll 212.

The rewinding roll 218 is connected to a rewinding motor which is a rewinding drive means, and rotated to apply a tension to the object 10 to be printed. In this case, if the supply roll 204 freely rotates, a tension applied to the object 10 to be printed is decreased or disappeared even with the rotation of the rewinding roll 218. In particular, if the rewinding roll 218 is stopped after rotating, the supply roll 204 continues to rotate with a rotational inertia so as to further unwind the object 10 to be printed.

In order to solve the above-described problem, the supply roll 204 is provided with a tension maintaining means so as to apply a constant tension to the object 10 to be printed positioned between the rewinding roll 218 and the supply roll 204 by rotation of the rewinding roll 218. As the tension maintaining means, a braking device such as a brake, a deceleration device such as a deceleration gear, or a reverse rotating device for rotating in a direction opposite to the rotation direction of the rewinding roll 218 may be used.

When using the deceleration device, by reducing the rotation velocity of the supply roll 204 with respect to the rotation of the rewinding roll 218, the tension may be applied to the object 10 to be printed positioned between the rewinding roll 218 and the supply roll 204. When using the reverse rotating device, since the tension is generated and applied to the object 10 to be printed in proportion to a difference between a torque applied to the rotation motor and a torque in a direction opposite to the torque applied to the reverse rotation device, it is more preferable than the deceleration device in regards to accurately controlling and maintaining the tension.

The device for supplying and rewinding an object to be printed for digital printing according to the first embodiment of the present invention basically has the above-described configuration, and an operating method thereof will be described below.

First, after mounting the supply roll 204, one end of the object 10 to be printed wound on the supply roll 204 is unwound, and sequentially passed through the first auxiliary roll 210, and the second transfer roll 212. Then, the one end of the object 10 to be printed is fixed to the rewinding roll 218. In this case, since the supply roll 204 is provided with the tension maintaining means, when one end of the object 10 to be printed is pulled by a force applied from the operator, with the object 10 to be printed being stretched, that is, being pulled with a tension applied thereto, the one end of the object 10 to be printed may be fixed to the rewinding roll 218.

In the related art, in order to install the object 10 to be printed, if the one end thereof is pulled by bending in various directions, it is difficult to continuously supply the object with a constant tension applied thereto. However, in the first embodiment of the present invention, since the object 10 to be printed is passed through the upper side of the first and second transfer rolls 210 and 212 by pulling at the same time, and mounted on the rewinding roll 218, it is possible to easily and simply perform the mounting work, and to install the object 10 to be printed while confirming the stretched state thereof. Therefore, since the object 10 to be printed is mounted on the rewinding roll 218 by pulling it from the supply roll 204 without wrinkles, there is no deviation in a width direction thereof.

Figure 5:
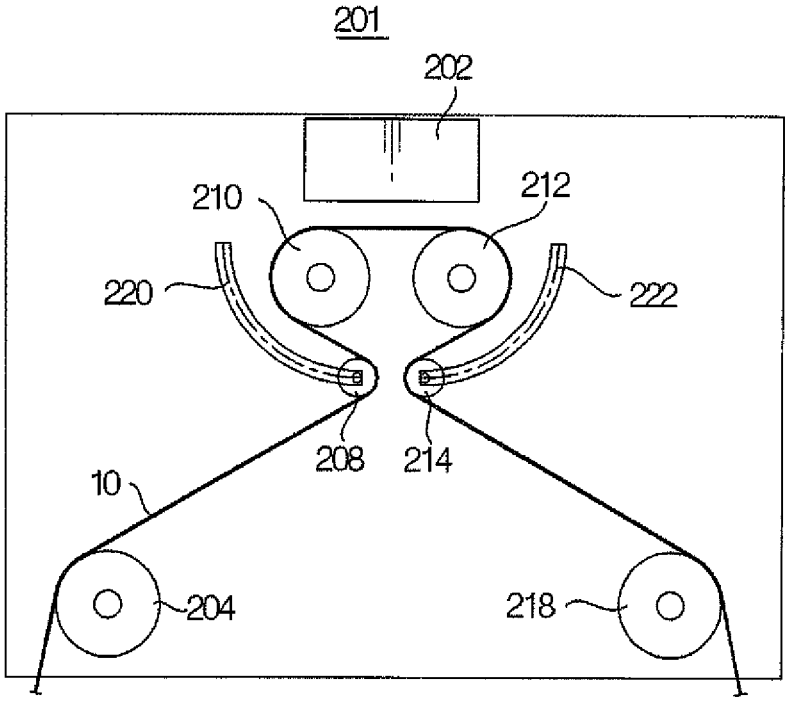
FIG. 5 is a schematic view illustrating a configuration of a digital printer in which a device for supplying and rewinding an object to be printed for digital printing is mounted according to a second embodiment of the present invention.
Figure 6:
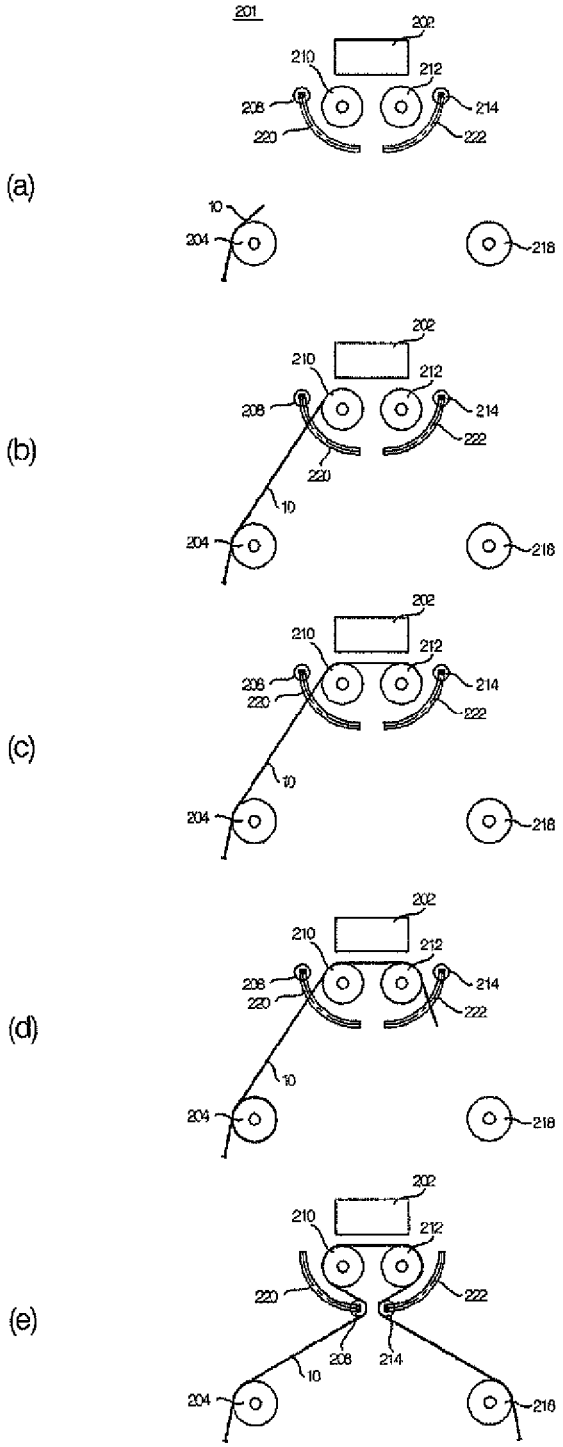
FIG. 6 is views illustrating a process of mounting the object to be printed in the digital printer of FIG. 4.

Next, a digital printer 201 in which a device for supplying and rewinding an object to be printed for digital printing is mounted according to a second embodiment of the present invention will be described with reference to FIGS. 5 and 6. In a case of the device for supplying and rewinding an object to be printed for digital printing according to the first embodiment, a contact area of the object 10 to be printed with the first and second transfer rolls 210 and 212 may be decreased compared to the related art. In order to solve this drawback, the device of the second embodiment has a contact increasing means. In the second embodiment, the components having configurations common to the first embodiment are denoted by the same reference numerals and will not be described in detail.

The device for supplying and rewinding an object to be printed for digital printing includes a supply roll 204 on which the object 10 to be printed is wound, a first transfer roll 210 which transfers the object 10 to be printed being supplied from the supply roll 204 to a lower side of a head unit 202, a second transfer roll 212 which discharges the object 10 printed with an image by the head unit 202, a rewinding roll 218 which rewinds and collects the object 10 printed with an image being discharged from the second transfer roll 212, a first guide 220 disposed between the supply roll 204 and the first transfer roll 210, a second guide 222 disposed between the rewinding roll 218 and the second transfer roll 212, a first auxiliary roll 208 which is movably installed in the first guide 220 to come close and press the object 10 to be printed loosely positioned between the supply roll 204 and the first transfer roll 210 so as to increase the contact area of the object 10 to be printed with the first transfer roll 210, and a second auxiliary roll 214 which is movably installed in the second guide 222 to come close and press the object 10 to be printed loosely positioned between the second transfer roll 212 and the rewinding roll 218 so as to increase the contact area of the object 10 to be printed with the second transfer roll 212.

The first guide 220 and the second guide 222 play a roll of the contact increasing means for increasing the contact area of the object 10 to be printed with the first and second transfer rolls 210 and 212 by pressing the object 10 to be printed previously installed by the operator. For this, the first auxiliary roll 208 is installed in the first guide 220 so that the object to be printed is proceeded along an outer circumference of the first transfer roll 210 positioned at an interval therewith, and the second auxiliary roll 214 is installed in the second guide 222 so that the object to be printed is proceeded along the outer circumference of the second transfer roll 212 positioned at an interval therewith.

In other words, the first and second guides 220 and 222 provide a curved trajectory or a plurality of linear trajectories so that the first and second auxiliary rolls 208 and 214 are positioned on lower sides of the first and second transfer rolls 210 and 212, respectively. Herein, the first and second guides 220 and 222 may be formed by various techniques known in the related art so that the first and the second auxiliary rolls 208 and 214 are rotatably supported and moved along constant trajectories by being installed in the first and second guides 220 and 222. For example, sliders in which the first and second auxiliary rolls 208 and 214 are rotatably installed are mounted on rails, or guide rolls which are integrally formed with the rotation axes of the first and second auxiliary rolls 208 and 214 are rotatably inserted in slits having constant trajectories.

The device for supplying and rewinding an object to be printed for digital printing according to the second embodiment of the present invention basically has the above-described configuration, and an operating method thereof will be described below.

First, after mounting the supply roll 204, one end of the object 10 to be printed wound on the supply roll 204 is unwound, and sequentially passed through the first transfer roll 210 and the second transfer roll 212. Then, the one end of the object 10 to be printed is fixed to the rewinding roll 218.

Next, the first auxiliary roll 208 and the second auxiliary roll 214 are moved along the first and second guides, such that the first auxiliary roll 208 and the second auxiliary roll 214 press the object 10 to be printed so as to be positioned at the lower side of the first transfer roll 210 and the second transfer roll 212. As a result, the object 10 to be printed comes into contact with a large portion of the outer circumferences of the first transfer roll 210 and the second transfer roll 212 to increase friction between the first and second transfer rolls 210 and 212 and the object 10 to be printed. Thereby, the object 10 to be printed may be stably transferred with the increased contact area.

Specifically, in order to prevent a large tension from being applied to the object 10 to be printed positioned between the first transfer roll 210 and the second transfer roll 212 by moving the first auxiliary roll 208 and the second auxiliary roll 214, it is preferable that, when any one of the first auxiliary roll 208 and the second auxiliary roll 214 is completely moved, the other auxiliary roll is moved.

In addition, during moving the first and second auxiliary rolls 208 and 214, since a large tension may be applied to the object 10 to be printed positioned between the supply roll 204 and the first auxiliary roll 208, and the second auxiliary roll 214 and the rewinding roll 218, it is preferable that the supply roll 204 and the rewinding roll 218 rotate so that the object 10 to be printed is unwound with a proper tension applied thereto by the rolls. For this, when firstly mounting the object 10 to be printed on the rewinding roll 218, it is preferable that the object to be printed is previously wound in a sufficient length in consideration of the unwinding by the first and second auxiliary rolls 208 and 214.

While the present invention has been described with reference to the preferred embodiments, the present invention is not limited to the above-described embodiments, and it will be understood by those skilled in the related art that various modifications and variations may be made therein without departing from the scope of the present invention as defined by the appended claims.

DESCRIPTION OF REFERENCE NUMERALS

100, 200, 201: digital printer, 102, 202: head unit
104, 204: supply roll, 108, 208: first auxiliary roll
110, 210: first transfer roll, 112, 212: second transfer roll
114, 214: second auxiliary roll, 118, 218: rewinding roll
220: first guide, 222: second guide

The invention claimed is:

1. A device for supplying and rewinding an object to be printed for digital printing comprising:

a supply roll on which the object to be printed is wound;

a first transfer roll which transfers the object to be printed being supplied from the supply roll to a lower side of a head unit;

a second transfer roll which discharges the object printed with an image by the head unit; and a winding roll which has a rotation axis parallel to a rotation axis of the supply roll, and is rotated by a rewinding drive means so as to rewind and collect the object printed with an image being discharged from the second transfer roll, wherein one end of the object to be printed is unwound and supplied from the supply roll, passed through an upper side of the first transfer roll and the second transfer roll, and fixed to the rewinding roll, a first guide is disposed between the supply roll and the first transfer roll, and a second guide is disposed between the second transfer roll and the rewinding roll, a first auxiliary roll configured to be moved along the first guide and installed to, after passing the object to be printed through the first and second transfer rolls and fixing to the rewinding roll, come close and press the object to be printed loosely positioned between the supply roll and the first transfer roll so as to increase a contact area of the object to be printed with the first transfer roll, and a second auxiliary roll configured to be moved along the second guide and installed to, after passing the object to be printed through the first and second transfer rolls and fixing to the rewinding roll, come close and press the object to be printed loosely positioned between the second transfer roll and the rewinding roll so as to increase the contact area of the object to be printed with the second transfer roll;

wherein the first guide is formed by a member having a groove that forms a circular arc about a central axis of the first transfer roll, and is installed so that the object to be printed which is transferred between the supply roll and the first roll passes while intersecting at a middle of the circular arc groove of the first guide, and the second guide is formed by a member having a groove that forms a circular arc about a central axis of the second transfer roll, and is installed so that the object to be printed which is transferred between the second roll and the rewinding roll passes while intersecting at a middle of the circular arc groove of the second guide, thereby the respective axes of the first and second auxiliary rolls are inserted and mounted into the respective circular arc grooves, so as to apply a tension to the object to be printed, wherein the first and second auxiliary rolls are guided along the circular arc grooves and are moved inward thereby pressing the object to be printed.

2. The device according to claim 1, wherein, when any one of the first auxiliary roll and the second auxiliary roll is moved, the other auxiliary roll is capable of being moved.

* * * * *